US005802981A

United States Patent [19]

Kassab

[11] Patent Number: 5,802,981

[45] Date of Patent: Sep. 8, 1998

[54] TWELVE-AXLE RAIL VEHICLE

[75] Inventor: Gabe M. Kassab, Pittsburgh, Pa.

[73] Assignee: Kasgro Rail Corp., New Castle, Pa.

[21] Appl. No.: 816,388

[22] Filed: Mar. 13, 1997

[51] Int. Cl.[6] ..... B61F 3/00

[52] U.S. Cl. ..... 105/176; 105/157.1; 105/167; 105/182.1; 410/44

[58] Field of Search ..... 105/157.1, 158.1, 105/159, 163.1, 167, 166, 168, 171, 176, 182.1, 183, 196, 211, 165; 410/44, 45

[56] References Cited

U.S. PATENT DOCUMENTS

| | | | |
|---|---|---|---|
| 757,427 | 4/1904 | Stewart | 105/176 |
| 1,144,329 | 6/1915 | Howard et al. . | |
| 1,504,252 | 8/1924 | Larsen . | |
| 1,762,887 | 6/1930 | O'Brien . | |
| 3,394,662 | 7/1968 | Weber . | |
| 3,908,559 | 9/1975 | Fromm | 105/157.1 |
| 4,041,879 | 8/1977 | Cockrell | 410/45 |
| 4,160,420 | 7/1979 | Hackbarth et al. | 410/45 |
| 4,164,906 | 8/1979 | Nieviarovski | 410/44 |
| 4,231,296 | 11/1980 | Jackson | 105/167 |
| 4,308,800 | 1/1982 | Mohacsi et al. | 410/44 |
| 4,341,494 | 7/1982 | Fefele | 410/45 |
| 4,901,649 | 2/1990 | Fehrenbach et al. | 410/45 |
| 5,315,934 | 5/1994 | List et al. . | |
| 5,327,837 | 7/1994 | Weber . | |
| 5,632,208 | 5/1997 | Weber . | |

*Primary Examiner*—Mark T. Le
*Attorney, Agent, or Firm*—Buchanan Ingersoll, P.C.

[57] ABSTRACT

A railway vehicle having twelve wheel and axle assemblies grouped into six 2-axle truck assemblies. Three truck assemblies are mounted on each of two span bolsters which in turn are mounted on opposite ends of a railway vehicle. All of the truck assemblies are rotatably mounted to the span bolster and the span bolster is rotatably mounted to the rail vehicle. The center assembly can be rotatably mounted about an axis common with the axis of the center plate of the span bolster. In some embodiments the spring assembly on the center truck assembly of each span bolster is lighter than the spring assemblies on the other truck assemblies mounted to the same bolster. In some embodiments the center truck assembly can move laterally more than the other truck assemblies on the span bolster.

12 Claims, 4 Drawing Sheets

LATERAL SHIFT

TWELVE-AXLE RAIL VEHICLE

RELATED APPLICATION

This Application claims the benefit of U.S. Provisional Application Ser. No. 60/013,651, filed Mar. 16, 1996.

BACKGROUND OF THE INVENTION

Railway vehicles have progressed from the simplest vehicle having a generally fixed axle at each end and four wheels into multi-axle vehicles having rotatable trucks. As the requirements to carry increased loads have increased, it has been required to increase the number of weight bearing wheel and axle assemblies to maintain reasonable rail/wheel loadings. A present commonly used freight car consists of a four axle vehicle suspension having two independent trucks each having two axles. Each axle pair is generally held in a set of side frames by a truck bolster having a rotatable connection to a center plate associated with the connection to the freight car body or side. With such a 2-axle bolster rotatably mounted on opposite ends of the car, the car is able to self-steer around curves. For some freight car applications it has been desirable to use two 3-axle truck bolsters mounted at opposite ends of the car. This provides a six axle (or twelve wheel ) car having two 3-axle trucks. Such addition of two axles and four wheels can result in higher carrying capacity of the vehicle. As the desire to carry increased loads has demanded additional wheel and axle sets, the dynamic performance of additional axles upon the car operation has been difficult to maintain consistent with existing track. Track curvature, and other roadway variables, make multiple axle high speed rail operation difficult.

One solution to increasing the carrying capacity of freight cars has been to utilize twelve axles in four truck bolsters, each truck bolster being a 3-axle bolster. Each end of the car is suspended by two 3 axle bolsters, which are joined by a span bolster. Each span bolster is then connected via a center plate to the vehicle. One such vehicle is known as QTTX131100, manufactured by National Steel Car Limited, of Canada. While such vehicle does have the weight capacity which results from the twelve axle/twenty-four wheel arrangement, dynamics and performance on curved track can be less than desired.

It would therefore be advantageous to have a railway freight car which has the capacity of a high axle vehicle and the dynamic performance compatible with existing rail conditions.

SUMMARY OF INVENTION

The invention utilizes a railway freight car having twelve axle/twenty-four wheel assemblies. The arrangement specifically utilizes six 2-axle trucks. Three 2-axle trucks are mounted rotatably on a span bolster. Each span bolster is rotatably mounted to a center plate adjacent one end of the vehicle. The resulting vehicle has a span bolster on either end with three 2-axle trucks mounted on each span bolster. It provides the carrying capacity for high tonnage loads and improved dynamic performance on curved track sections, along with other advantages.

DESCRIPTION OF SOME EMBODIMENTS

Figure 1:
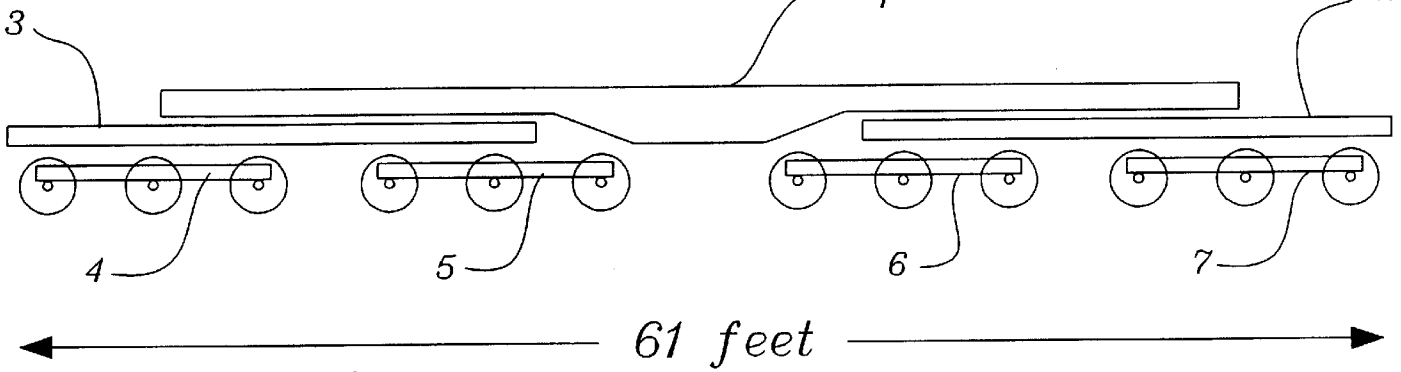
Fig.1. Prior Art
FIG. 1 shows a prior art design of a QTTX car utilizing four 3-axle trucks.

Referring to FIG. 1 shows a diagram of a National Steel Car, QTTX, which utilizes four 3-axle trucks, 4, 5, 6, 7. The car body 1 is mounted on two span bolsters 2 and 3. Each span bolster 2, 3 is fitted to hold two truck assemblies. Span bolster 3 mounts two 3-axle truck assemblies, 4 and 5, while span bolster 2 mounts two 3-axle truck assemblies 6 and 7. Because of the 3-axle truck arrangement the performance on curved track, specifically tightly curved track, of such four 3 axle truck cars is less than desired.

Figure 2:
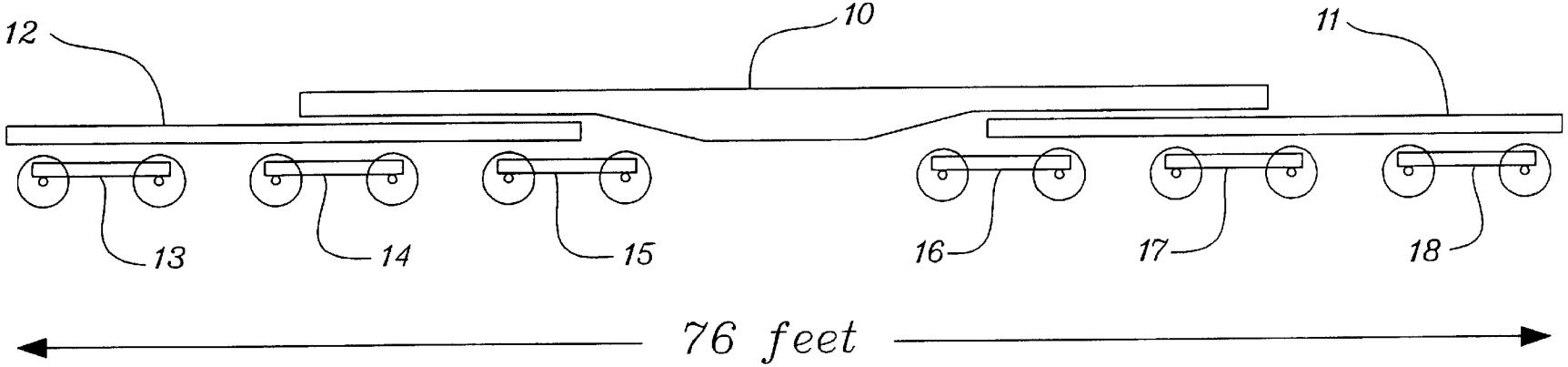
FIG. 2 shows one embodiment of the invention utilizing two span bolsters, each having three 2-axle trucks rotatably connected thereto.

FIG. 2 shows an embodiment of the invention in which a car body 10 has mounted on either end two span bolsters 11 and 12. Each span bolster 11 and 12 is rotatably mounted to car body 10 by a center plate. Span bolsters 11 and 12 each have three 2-axle truck bolster assemblies mounted. Truck bolsters 13, 14, and 15 are rotatably mounted to span bolster 12 by means of separate center plates for each of the three 2-axle truck bolsters. Similarly, span bolster 11 has three center plate mountings to truck bolster assemblies 16, 17, and 18.

Figure 3:
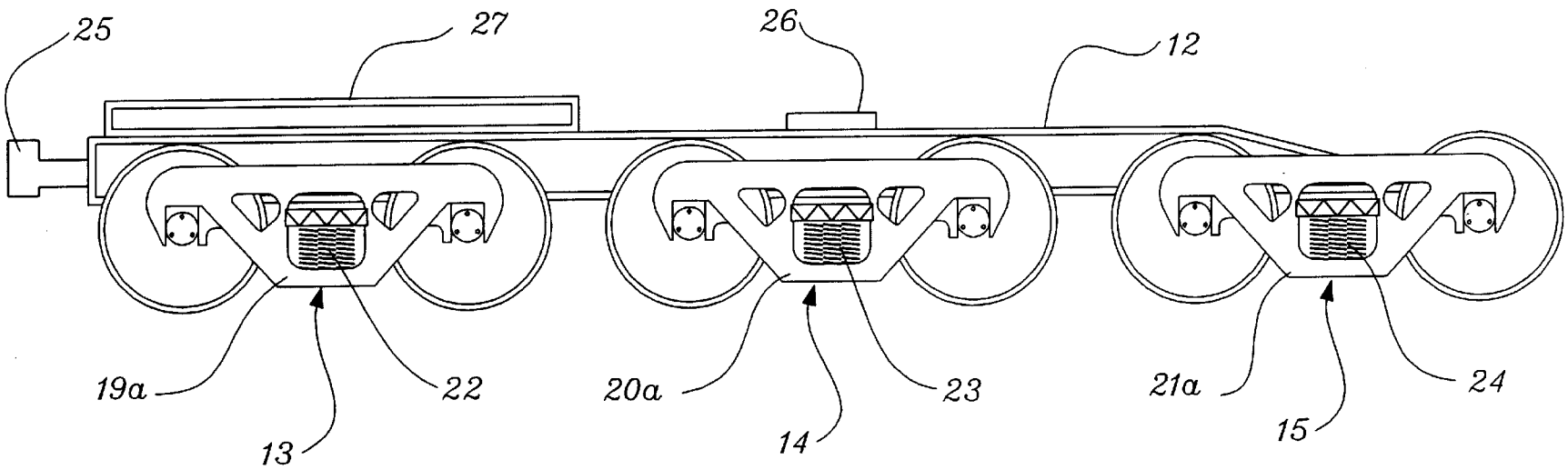
FIG. 3 shows a span bolster with three 2-axle trucks connected to it, and having a coupling on one end.

Referring to FIG. 3 there is shown a single span bolster assembly 12. The span bolster 12 has mounted thereon three truck assemblies 13, 14, and 15. Each truck assembly is a 2-axle assembly having four wheels. Each truck assembly 13, 14, and 15 has frame portions 19*a*, 20*a*, and 21*a* and load springs 22, 23, and 24, respectively, mounted in the pockets between their individual bolster ends. While a variety of 2-axle bolsters may be used in practicing the invention it is presently preferred that the 2-axle truck assembly manufactured by National Castings under the trademark, SWING MOTION TRUCK, be utilized. While a number of wheel and axle assemblies can be used, presently preferred embodiments as shown in FIG. 3 utilize axles in seven inch by twelve inch bearing journals. Cars can be constructed having gross loadings up to three hundred and seventy tons, although use of other components could increase this load even higher.

While in some embodiments all three truck assembly spring sets 22, 23, and 24 can be equal, it may be advisable in other embodiments to provide the center 2-axle truck bolster spring set 23 of a lighter load capacity. One of the advantages of having lighter springs in the center bolster at 23 can be improved dynamic performance in operation of empty or lightly loaded vehicles. Having a lighter spring set in the center bolster distributes the loading more to the leading and following bolster in each span bolster group. In some applications this may reduce hunting and improving performance of the vehicle.

In some applications, a portion of the span bolster 12 will extend beyond the length of the body 10 as shown in FIG. 2. In such instances, it may desirable to add an end platform or end plate 27. While such platforms have been added in other railway vehicles as a position for locating equipment such as hand brakes, they have previously been mounted in a less than rigid condition. It is desirable in some embodiments of the invention to mount the end plate 27 in a very rigid manner to the span bolster 12. This can be done by welding the plate securely, bolting, or integral forming the platform to the span bolster 12. The result of rigidly fixing the platform to the span bolster is to provide additional rigid cross support to reduce flexing of the span bolster 12.

Figure 4A:
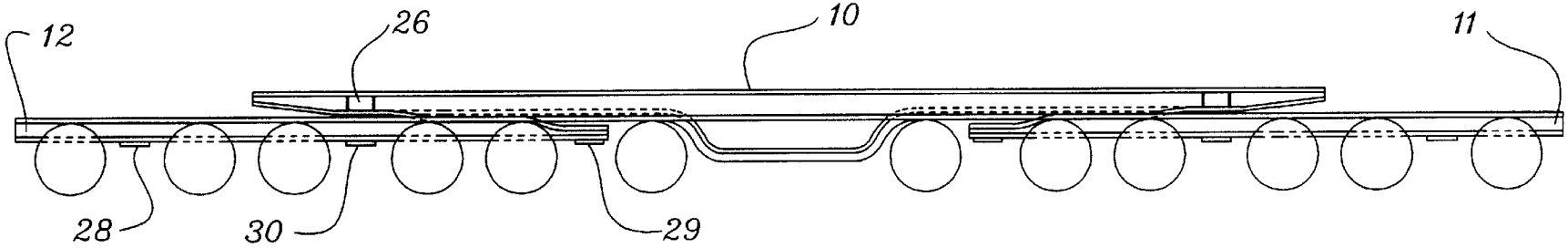
FIG. 4*a* shows a side view of a flat car assembly fitted to two span bolsters, each having three 2-axle trucks.
Figure 4B:
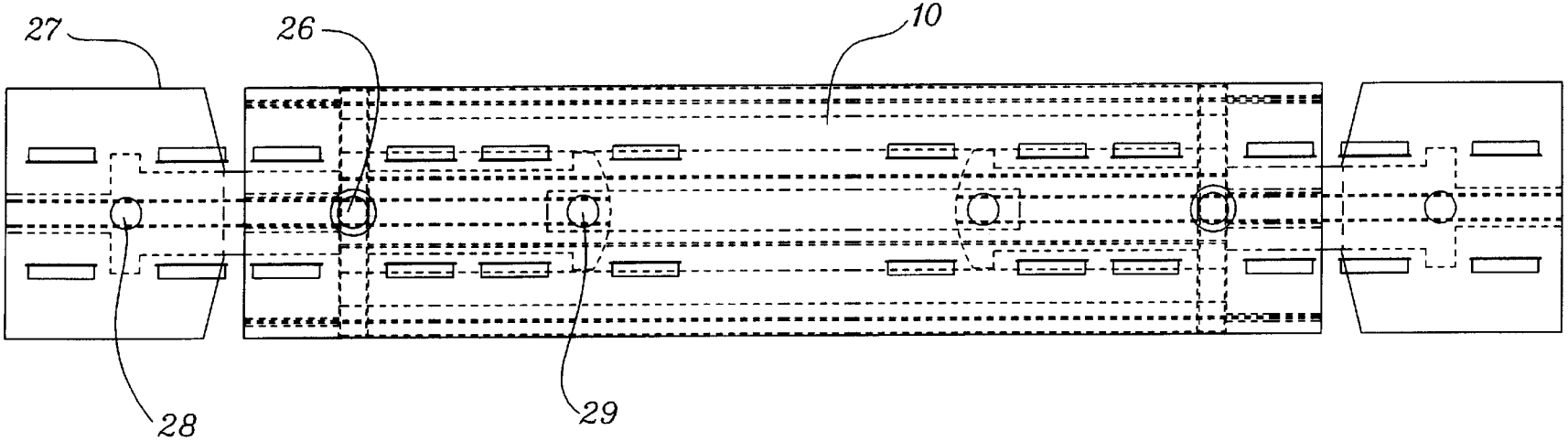
FIG. 4*b* is a plan view of the vehicle of FIG. 4*a* showing the wheel, bolster, and truck center sill arrangements.

Referring to FIGS. 4*a* and 4*b*, there is shown a car using an embodiment of the invention having two three truck span bolsters, and each truck being a 2-axle truck. Body 10 is rotatably mounted on span bolsters 11 and 12. A center plate 26 is located to rotatably mount the span bolster 12 to the body 10. As can be seen, a truck bolster center plate 30 is used to mount the center 2-axle truck to the span bolster 12. In this instance the center plate 30 for the truck bolster is mounted in alignment with the span bolster center plate 26. The leading and following trucks on span bolster 12 are rotatably mounted via truck bolster center plates 28 and 29 respectively. The platform 27 is also seen in FIG. 4*b*. While the bolster and center plate alignments have been described with regard to FIGS. 4*a* and 4*b* as they relate to span bolster 12, it is apparent from the figures that identical mountings are provided with span bolster 11.

FIG. 4*b* also shows the arrangement of all twenty four wheels and both end platforms. It is to understood that while the description in this specification has described a vehicle body 10 and has generally shown a flat car body, the application applies to any type of car body, and especially specialty cars where high weight objects are to be carried.

It is also envisioned that two stage suspension springs would be utilized in some embodiments of the vehicle. This would provide a softer ride for empty vehicles and stiffer support for full loaded cars.

Figure 5:
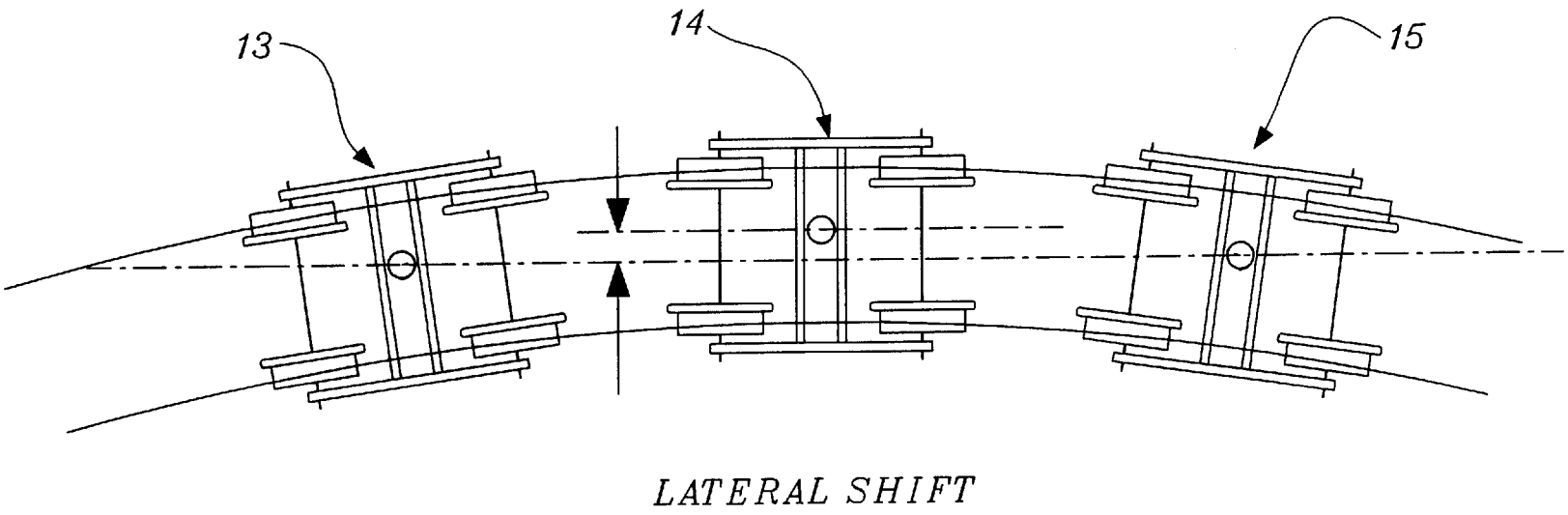
FIG. 5 shows three trucks on a tight curve and the lateral shift component which is available in the three 2-axle span bolster assembly.

FIG. 5 shows a diagrammatic arrangement of the truck assemblies 13, 14, and 15 on bolster 11 in a tight curve. The arrows define the lateral shift required of the center truck. In a one hundred and eighty foot radius curve, a lateral shift of approximately 3.7 inches would be required. This can be accomplished by designing a middle center plate on the span bolster to permit this lateral movement. In addition, the utilization of trucks with a high degree of lateral suspension travel may be utilized, National Casting SWING MOTION TRUCKS provide generally sufficient travel. Some additional travel can be taken up in the wheel rail interface and in the three center bowls of trucks 13, 14, and 15. Again, by using a lighter spring loading on the center truck can permit more lateral shift to the center truck of the span bolster.

A typical three hundred and seventy ton flat car utilizing the invention could have the following characteristics:

Light weight—201,000 pounds

Load weight—744,000 pounds

Deck length—50 feet

Deck width—10 feet, 8 inches

Deck height—54.5 pinches

Length over coupler pulling faces—77 feet 8 inches

Clearance profile plate C, maximum cooper rating E 90.

Such a vehicle would use six one hundred and twenty-five ton National Casting SWING MOTION 2-axle trucks. Each truck would have a roller bearing size of 7 by 12 inches. Wheel diameter could be 38 inches, with truck center spacing of 10 foot 6 inches. The span bolster center spacing could be 40 foot.

While some embodiments of the present invention have been described in detail, it is to understood that other embodiments of the invention can also be utilized by those skilled in the art. Such other embodiments are included within the scope of the following claims.

What is claimed is:

1. A railway vehicle comprising:

(a) a body, (b) two span bolsters rotatably mounted to said body, and (c) each of said span bolsters having three 2-axle truck assemblies rotatably attached at three separate locations on said each of said span bolsters thereby supporting said vehicle on twelve axles and twenty four wheels.

2. The railway vehicle of claim 1 further comprising a center truck assembly of said three 2-axle truck assemblies on at least one of said span bolsters being rotatably mounted about an axis common to the axis of rotation of said one span bolster with said body.

3. The railway vehicle of claim 2 wherein said center truck assembly has a spring suspension stiffness less than the spring suspension stiffness of the other of said truck assemblies mounted on said one span bolster.

4. The railway vehicle of claim 1 wherein at least one of said span bolsters has a rigid platform affixed on a top side thereof opposite said truck assemblies.

5. The railway vehicle of claim 2 wherein the center truck assembly on at least one of said span bolsters is mounted on a middle center plate to said span bolster permitting larger lateral movement between said center truck assembly and said one span bolster than the other truck assemblies and said one span bolster.

6. The railway vehicle of claim 3 wherein the center truck assembly on at least one of said span bolsters is mounted on a middle center plate to said span bolster permitting larger lateral movement between said center truck assembly and said one span bolster than the other truck assemblies and said one span bolster.

7. A railway vehicle undercarriage for rotatably supporting one end portion of a railway vehicle body comprising:

(a) a span bolster; and (b) three 2-axle truck assemblies rotatably attached at three separate locations on said span bolster thereby supporting said span bolster on six axles and twelve wheels; and (c) a center plate in said span bolster to rotatably connect said span bolster to an end portion of the railway vehicle body to support the railway vehicle body on the span bolster.

8. The railway vehicle undercarriage of claim 7 further comprising a center truck assembly of said three 2-axle truck assemblies on said span bolster being rotatably mounted about an axis common to the axis of rotation of said span bolster with said body.

9. The railway vehicle undercarriage of claim 8 wherein said center truck assembly of said span bolster has a spring suspension stiffness less than the spring suspension stiffness of the other of said truck assemblies mounted on said one span bolster.

10. The railway vehicle undercarriage of claim 8 wherein said span bolster has a rigid platform affixed on a top side thereof opposite said truck assemblies.

11. The railway vehicle undercarriage of claim 8 wherein the center truck assembly is mounted on a middle center plate to said span bolster permitting larger lateral movement between said center truck assembly and said span bolster than the other truck assemblies and said span bolster.

12. The railway vehicle undercarriage of claim 9 wherein the center truck assembly is mounted on a middle center plate to said span bolster permitting larger lateral movement between said center truck assembly and said one span bolster than the other truck assemblies and said one span bolster.

* * * * *